US006453589B1

(12) United States Patent
Schwartz

(10) Patent No.: US 6,453,589 B1
(45) Date of Patent: Sep. 24, 2002

(54) ESSENTIALLY OPEN FILE FOLDER

(75) Inventor: David C. Schwartz, Southboro, MA (US)

(73) Assignee: Productive Environments, Inc., Framingham, MA (US)

( * ) Notice: Subject to any disclaimer, the term of this patent is extended or adjusted under 35 U.S.C. 154(b) by 0 days.

(21) Appl. No.: 09/247,786

(22) Filed: Feb. 9, 1999

Related U.S. Application Data

(60) Provisional application No. 60/075,688, filed on Feb. 24, 1998, and provisional application No. 60/074,370, filed on Feb. 11, 1998.

(51) Int. Cl.[7] ..... B65D 27/00

(52) U.S. Cl. ..... 40/359; 40/649; 229/67.1; 229/67.4; 229/71; 281/29; 281/31

(58) Field of Search ..... 40/359, 642.02, 40/649, 661.08; 229/67.1, 67.4, 71, 77; 281/29, 31, 37

(56) References Cited

U.S. PATENT DOCUMENTS 1,529,264 A * 3/1925 Mayers ..... 229/67.1
1,774,215 A * 8/1930 Weinthrop ..... 229/71 X
3,933,294 A * 1/1976 Meenan et al. ..... 40/359 X
4,109,850 A * 8/1978 Meenan et al. ..... 40/359 X
4,583,764 A * 4/1986 Steffen ..... 281/31
5,174,606 A * 12/1992 Hure ..... 40/359 X
5,890,774 A * 4/1999 Schwartz et al. ..... 281/31
5,904,374 A * 5/1999 Lee ..... 281/29
5,988,685 A * 11/1999 Mogelonsky et al. ..... 281/31

* cited by examiner

*Primary Examiner*—Jack Lavinder
*Assistant Examiner*—James M. Hewitt

(57) ABSTRACT

This invention provides for an essentially open file folder construction where the containment means allows for use of the file folder in an open style as featured in all file folders, while at the same time providing for a box like closure structure that allows for closure along the spine and orthogonal bottom edge of the file folder, which locking closure has the additional feature of showing a substantial portion of the contents, enabling a self typing categorization of the folder by way of the meaning first member contained therein, which member is partially viewable when said file folder is set into its locked configuration. The primary basis for offering the locking feature is by way of a retaining panel along a bottom portion of the back panel with a leading edge substantially at or partially offset from a hinged front panel such that the hinged front panel, when folded backward and into the file folder may be latched behind the retaining panel to lock the front panel in a half open position, thereby forming a containment system, with no other supports for closure than the locking front panel and retaining flap.

5 Claims, 10 Drawing Sheets

ESSENTIALLY OPEN FILE FOLDER

This application is a formal filing on PPA 60/074,370 filed Feb. 11, 1998 and PPA 60/075,688 filed Feb. 24, 1998.

BACKGROUND

Front and back cover file folders are and have been a staple in the office. Developments in file folders have expanded the category substantially. Aside from being used inside of suspension or hanging folders, alternatives have arisen to the file folder. File folders have been made with expanding spines. Additionally, there are dual portfolios having front and back covers, each pocketed. There are file jackets, slash pockets, and wave pockets. These offer closure on three sides. Further, there are project pockets which employ clear poly material tinted in different colors and are closed on two edges. Flap string tie pockets have been made in the same material offering closure on four sides. Additionally, there are "smart folios". These have front and back covers with no pockets, but on the back cover there are three flaps to provide containment. Smart folios also have elastic strings to close the outside flap across both outside covers or across the outside edge, longitudinally from top to bottom. File folders solely with front and back covers, made of more rigid material have also arisen that have elastics across the same portions.

This invention relates to filing products intending to offer some form of containment other than simply a spine with front and back covers. There are limitations in the containment mechanisms employed thus far.

File jackets and related products closed on two, three, or four sides do not open in book form like traditional file folders. They are really in a different category. Even provided with expansion or made clear, they do not open to allow reordering or shuffling of the contends as traditional file folders do.

Smart folios open like file folders but contain three flaps on the back pocket and elastics that close either or both outer corners. In order to get at the contents to shuffle, the strings must be retracted from the outer edge and the front cover substantially fully opened to 180 degrees to lay open the three flaps on the back panel. This operation is required to shuffle and to file into the contents.

File folders with outer edges closed by elastics also require the elastic withdrawn if the corners are contained, if one is to file into the folder. If a longitudinal elastic is employed, filing can occur without opening.

Although the latter product is essentially open, these products are normally made from opaque material so that another limitation of the prior art is that the file folders have to be substantially opened to determine the contents. Labels serve to establish contents but complete disclosure requires an open operation.

An elastic string can be put on a clear poly file folder of substantial thickness not to curl. This would resolve the "nonself typing" limitation of opaque folders. (note: a self typing folder has some means to see the top sheet without an open operation). Such a product would have higher cost which would be a commercial limitation. Further, a full or substantial full open would be the standard mode of use for shuffling since removal of the elastic would typically open three sides.

OBJECTS AND ADVANTAGES OF THE PRESENT INVENTION

The object of the present invention is to provide a file folder that opens and closes with a front and back cover as a traditional file folder, is made from traditional paper board, yet offers additional modalities of operation which permit, (1) self typing by one of two structures, (2) shuffle filing without opening while providing at least two sided containment or closure, (3) at least three or four sided closure for transportation and instant shuffling on open without having to lay open any additional panels It is an object of this invention to provide for a file folder having a clear portion of a front cover, which clear portion permits self-typing, i.e. the recognition of the contents without explicitly placing a label on the folder. It is a further object of this invention to provide a front panel of said file folder wherein a portion of the panel, substantially half, is hinged in order to provide the ability to fold the hinged portion back or inward to expose the contents of the file folder without fully opening the file folder, where open would normally entail the rotation of the front cover substantially 90–180 degrees from the closed(coplanar position of front and rear cover). It is a further object of this invention to provide for a retaining panel along a portion of the back panel side which would be viewed as the bottom edge of the file folder when looking at it, where the leading edge of this retaining panel is substantially at or partially offset from said hinged front panel such that the hinged front panel, when folded backward and into the file folder may be latched behind the retaining panel to lock the front panel in a half open position, thereby forming a containment system, with no other supports for closure than the locking front panel and retaining flap. It is a further object of this invention to provide for such a file folder as detailed above, wherein said file folder is augmented by at least one elastic strapping element, in the form of an elastic string or like member, where said elastic strapping member is retained on the back panel of the file folder so as to be available on the back side of the back panel, to be pulled by way of its elastic properties, over at least one corner of said file folder when said file folder is in its traditionally and/or flap locked closed position. It is further an object of this invention to provide for an additional locking means for allowing the hinged leading edge of the front cover to be retained in a slot on the trailing edge of the front cover to permit it to be retained in a folded open position without need for any auxiliary retaining means to keep it in place. It is further an object of this invention to offer the above defined file folder with a front cover that is fully clear or has a portion removed to provide for a clear, see through feature. It is an object of this invention to provide for retaining flaps of various constructions retaining flaps with expansion portions, and retaining flaps that are recessed from the hinge of said front cover and further comprise step recesses to allow the expansion of the locked members as the file folder is filled with papers. It is an object of this part of the invention to provide for a step wise or smooth expansion of the locked portion in direct ratio to the expansion portion of the spine of the file folder. Further, it is an object of this invention to provide for various means of construction

SUMMARY OF THE INVENTION

Figure 1:
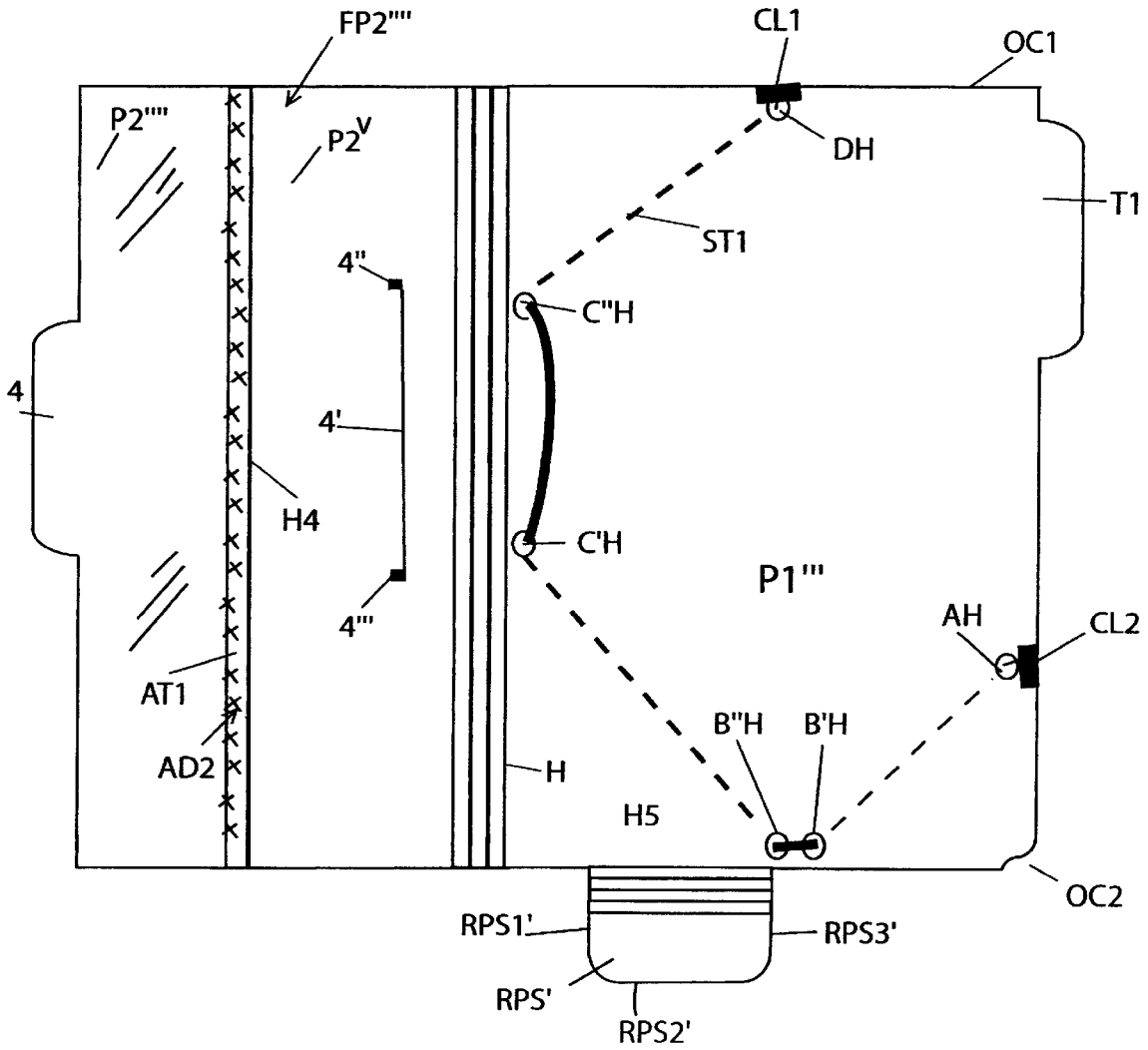
FIG. 1 depicts an open file folder comprising a clear paneled portion front cover, with a hinged folding axis, a flap retaining tab and slot, and a retaining panel for locking the folding portion of the front panel, and further displaying a three corner elastic band configuration.

The invention provides for an open file folder comprising a clear paneled portion front cover, with a hinged folding axis, a flap retaining tab and slot, and a retaining panel for locking the folding portion of the front panel, and further comprising a three corner elastic band configuration. This file folder can be closed in its "substantially open format" with the leading half of the front cover hinged panel folded back and retained behind the elastics corners. It can also be closed with the front cover closed and retained behind the third corner portion of the elastic band member.

The invention provides for a file folder with a hinged front cover in combination with a retaining panel and having a hole configuration for retaining a elastic band into a three corner locking configuration where the elastics can be attached with "T" ends or riveted using a standard riveting structure for holding such an elastic band in a hole.

The invention provides for various ways of closing the file folder other than just placing the covers one on top of the other in coplanar position. In particular, a means of essentially open closure is offered where the front cover is flapped back on its hinge and retained behind elastic corner retaining structures utilizing one of the above mentioned configurations. Note, in this and the above mentioned configurations where an elastic is deployed, the hole for holding the elastic is located on the rear panel and is substantially collocated with the position of the hinge on the front panel such that when the elastic is pulled up onto the front of the file folder, the elastic does not interfere with the ability to fold the front panel back and positions the elastic behind the hinge panel portion when it is actually folded back or folded locked inward.

The invention provides for a variety of means for seeing through the front cover including plastic covers where a fully clear plastic cover is laminated to an opaque backed file folder, a file folder having a front hinged cover that is additionally carved out to allow for partial see through, further comprising a retaining flap with a recessed portion for allowing the smooth deployment of the hinged front flap portion in the locked position when papers are added.

The unique structure which provides the unexpected advantage of a file folder that has traditional open and close features, while offering the ability to prevent papers from falling through the bottom, and at the same time offers the additional capability of having two essentially closed edges, a spine and a portion of the orthogonal bottom edge is the hinged front cover flap which folds and locks behind a partial retaining flap aligned so that the hinge nests neatly within, with partial expansion portion to form a box like structure for even more securely holding papers securely from dropping out the bottom and not allowing the top cover of the file folder to open.

The provision of the folding lock in optional combination with the elastic locking means offers a way to introduce this product at the high end of the market, with the elastics, in a more substantially rigid construction material. The more rigid construction material supporting the pull of the elastics and keeping the file folder uncurled and generally flat. Once the general features are appreciated, the file folder can be introduced in a lower cost format using solely the novel locking means alone while retaining substantially the essentially open properties of the proposed construction.

Additional containment is offered for the file folder similar in configuration to the above described units, where the retaining panel has two slanted sides for allowing easy closure and smooth locking.

DETAILED DESCRIPTION

Figure 1A:
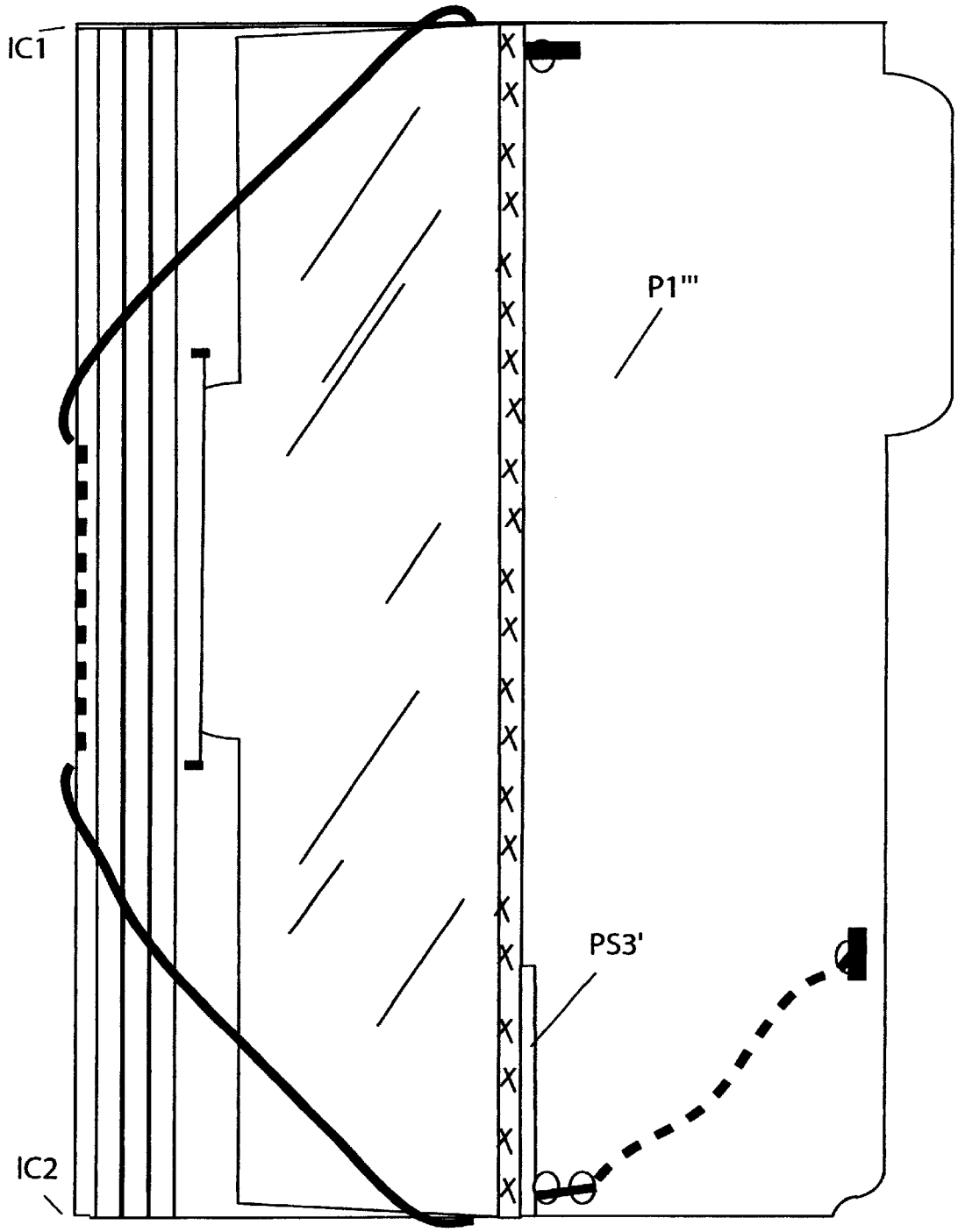
FIG. 1*a* shows the file folder of FIG. 1 closed in its substantially open format with the leading half of the front cover hinged panel folded back and retained behind the elastics corners.
Figure 1B:
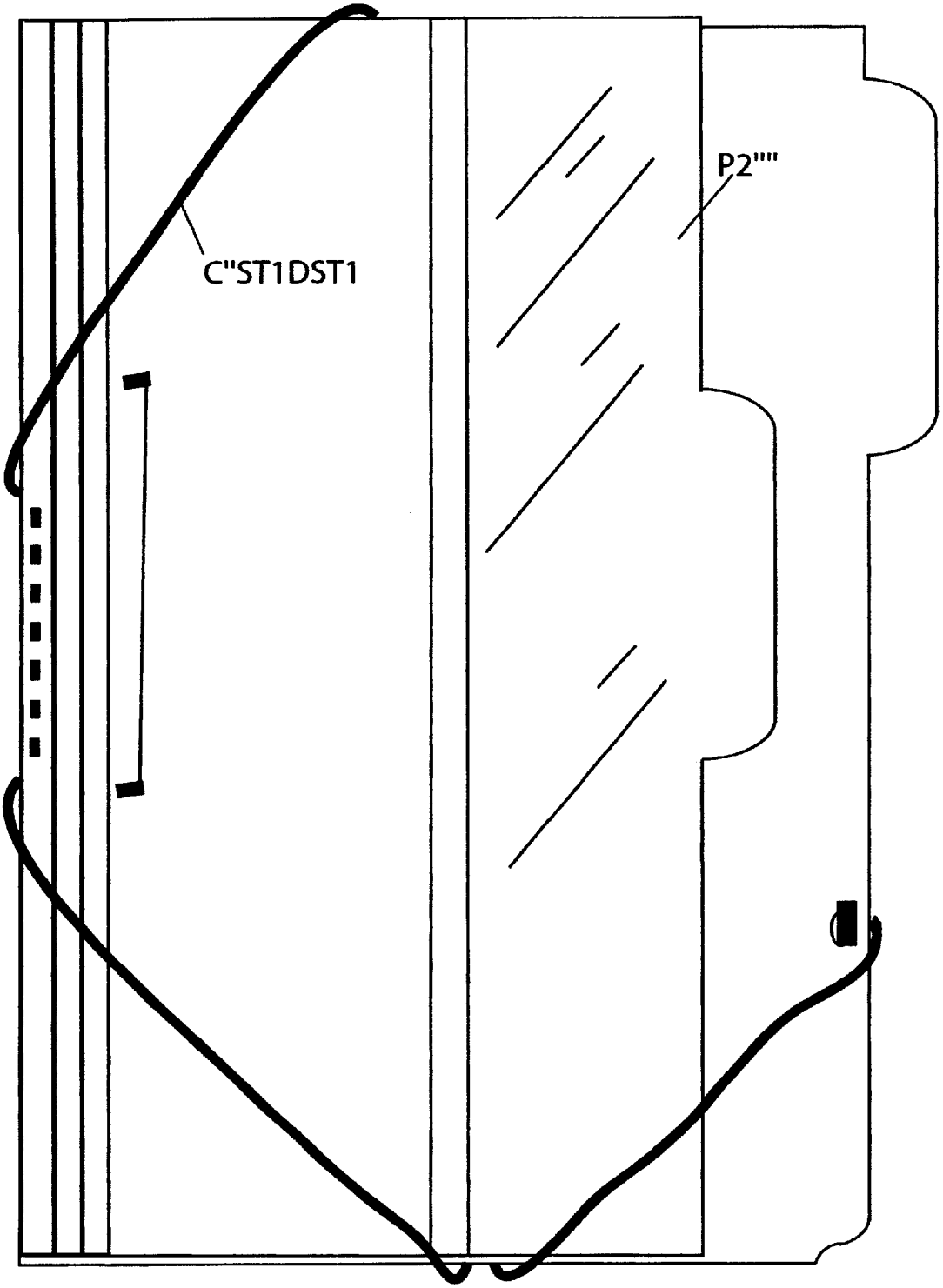
FIG. 1*b* shows the file folder of FIG. 1*a* with the front cover closed and retained behind the third corner portion of the elastic band member.
Figure 2:
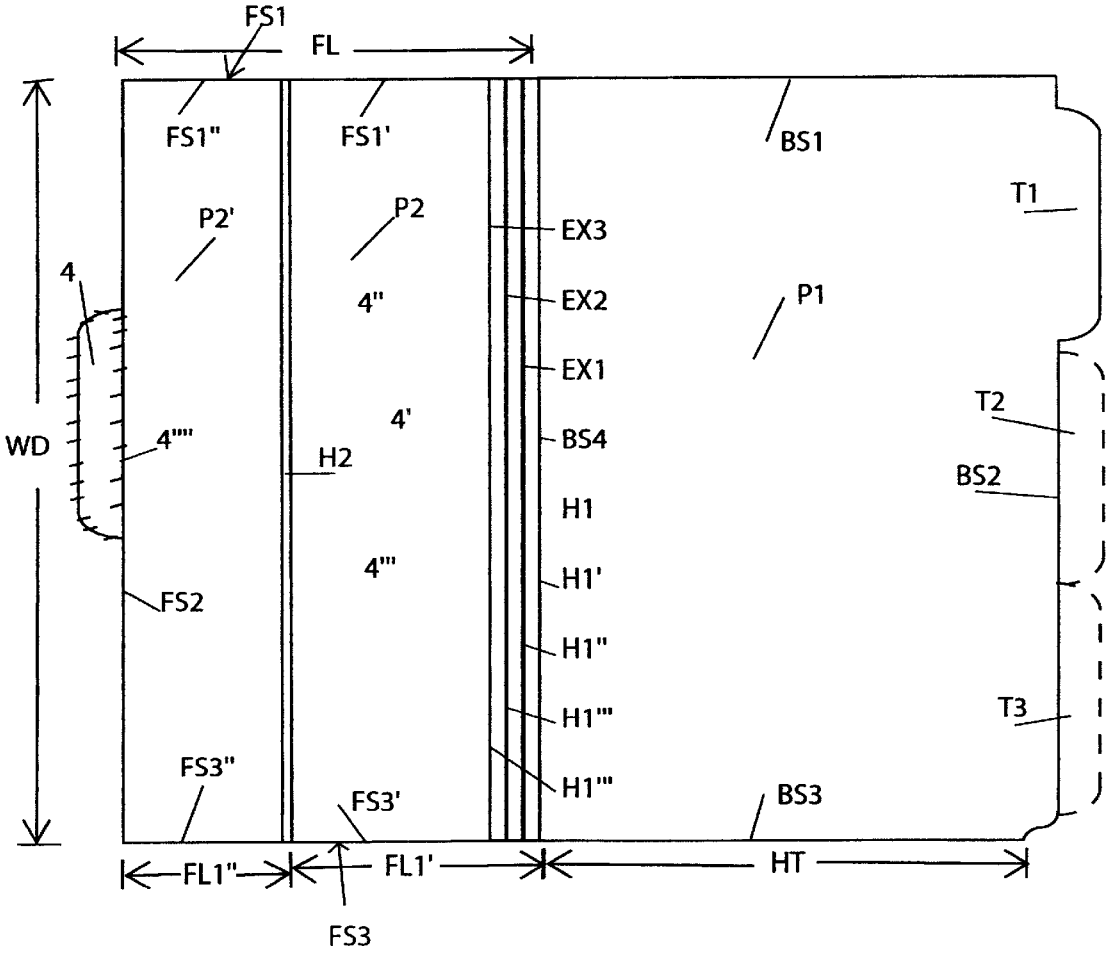
FIG. 2 Shows a file folder with a hinged front cover.
Figure 3:
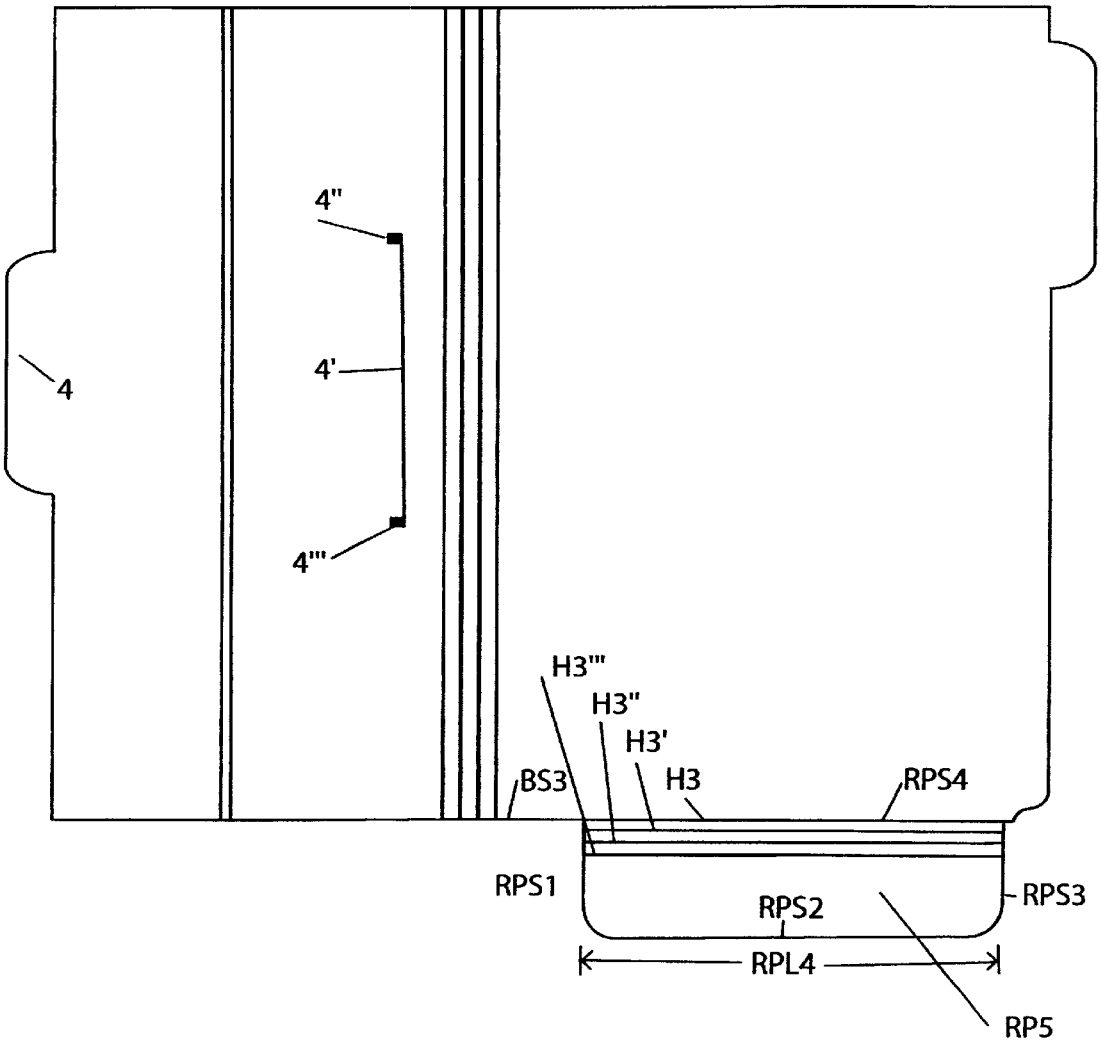
FIG. 3 shows the file folder of FIG. 2 with a retaining panel that spans substantially the entire bottom portion of the rear or back panel.

A preferred embodiment, as shown in FIG. 1, FIG. 1A, and FIG. 1B has a front cover FP2", back cover P1'", spine H, and retaining panel RPS' with expansion hinge H5. The front panel comprises 2 panel portions. There is a clear portion P2"" and an opaque paper board portion P2/v which portion attaches via hinge H to back panel P1'". P2/v, H P1'" would typically and preferrably be a paperboard. The clear plastic p2"" would be adhesively attached to panel AT1 with adhesive AD2. Panel AT1 is hinged to panel P2/v by hinge H4 and is also integral to the paper board portion above referenced. The tab T1 can be third, fifth, or full cut or any other variation. Optional tab 4 can fit into optional slot 4", 4', 4'" where 4" and 4'" are easy entry holes. Elastic string ST1 Is preferrably a fabric elastic coated elastic although it can be a pure rubber band. It is any stretchable material terminated such that it can be threaded through holes AH, B'h, B"h, C'H, C"h, and DH. The termination would preferrably be made with metal tubbies CL1 and CL2 but termination can be by other means. The holes AH–>DH can be protected with mylar or metal reinforcers as can any or all of the hinged panels. The tabs T1 can be film coated for write erase use.

Operation permits self typing by way of the hinged repositioning of panel p2"" either inside or outside the folder by folding back 180 degrees or by view, if closed, through the clear material. Retaining panel RP5' provides bottom closure in combination with the cover and string ST1.

Filing can thus be achieved when the file folder is closed with the two inner corners strapped, when the cover is half opened and the two inner corners EC1 and IC2 are strapped, or when the cover is either open ½ or closed and inner cover IC2 and outer cover OC2 are strapped.

The additional figures show different embodiments. The entire pocket can be poly, opaque, or clear.

Figure 4:
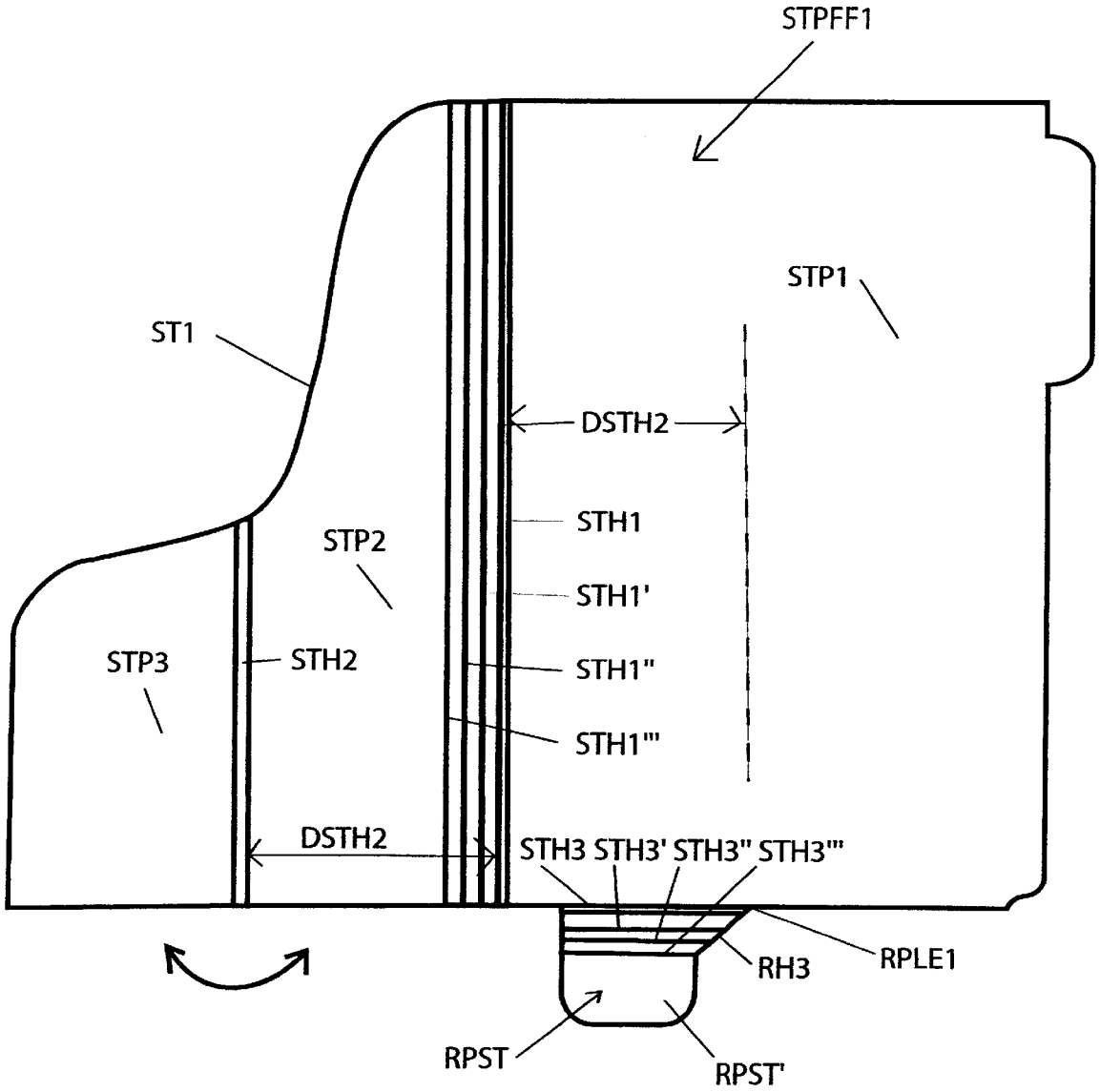
FIG. 4 shows a file folder having a front hinged cover that is additionally carved out to allow for partial see through, and displays a retaining flap with a recessed portion for allowing the smooth deployment of the hinged front flap portion in the locked position when papers are added.
Figure 4A:
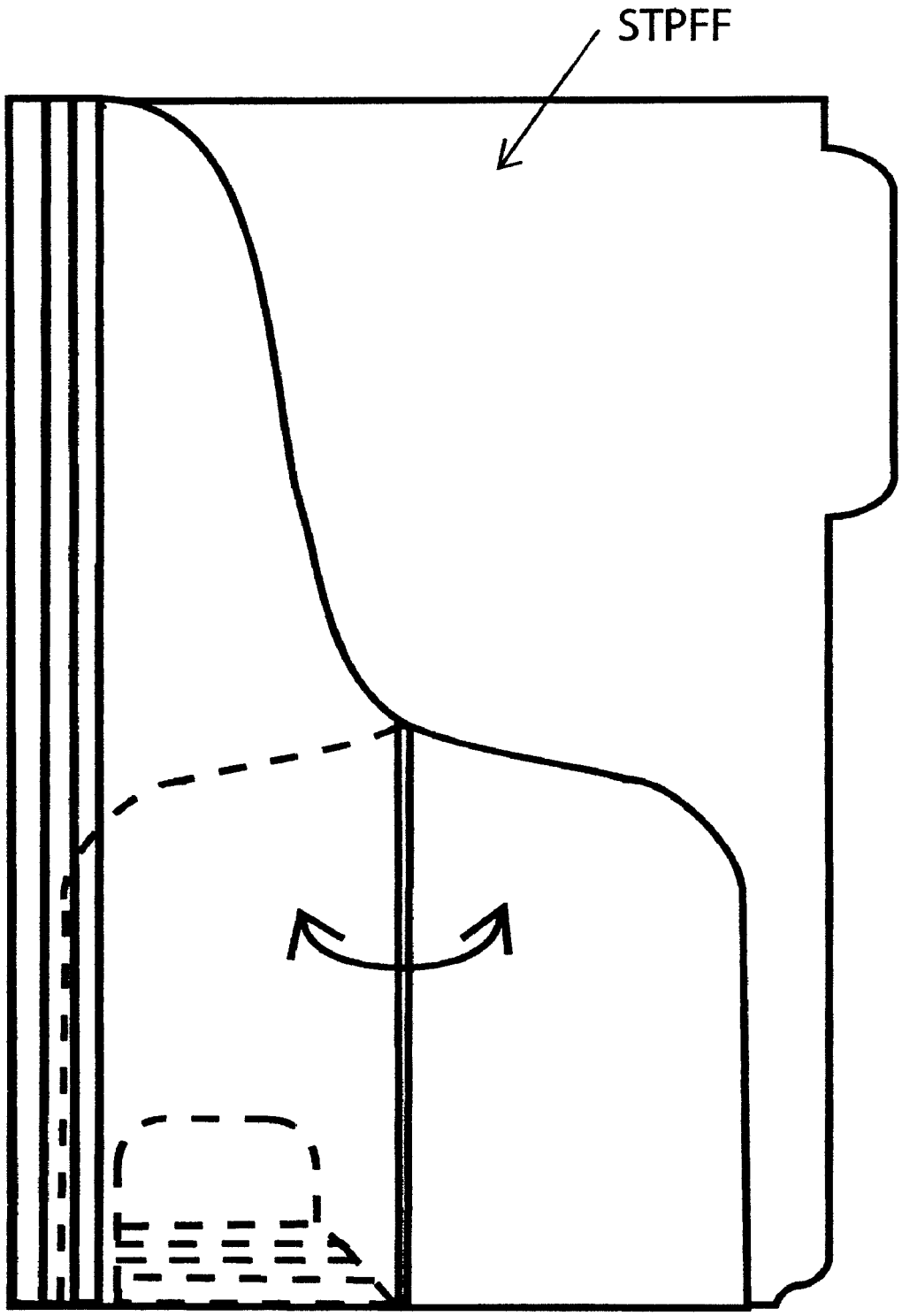
FIG. 4*a* shows the file folder of FIG. 4 with the front flap coplanar with the back flap, displaying the hidden retaining flap and showing the position for folding the hinged portion of the front cover into the file folder for locking.
Figure 4B:
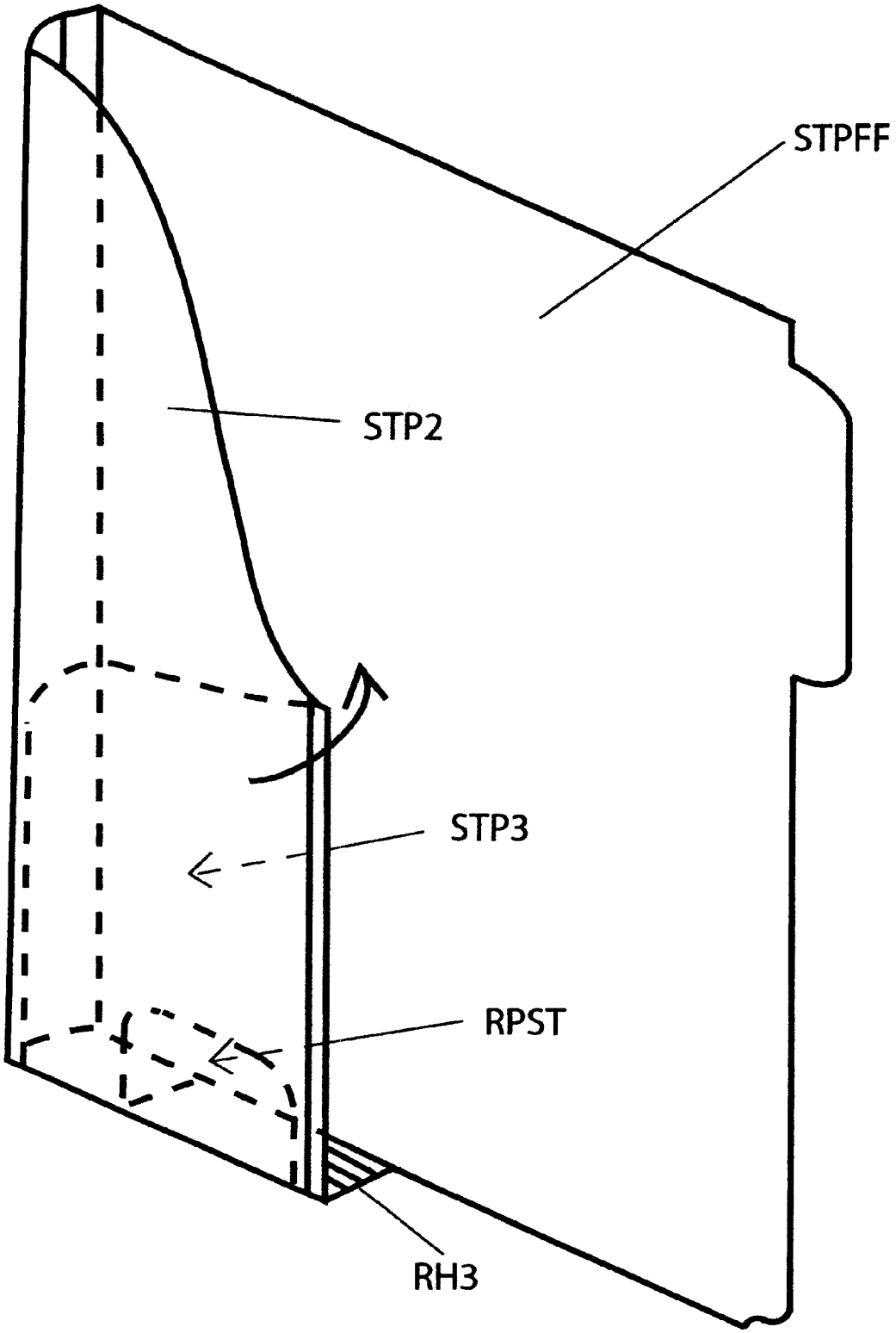
FIG. 4*b* Shows a perspective drawing of the file folder of FIG. 4*a* with the hinged front cover flap folded into the pocket, locked behind the retaining flap, and partially expanded to form a box like structure for holding papers securely from dropping out the bottom.

A further preferred embodiment is shown in FIG. 4 where a self typing project file folder is shown. The self typing feature, I.e the ability to determine the contents through the front cover when the front cover is closed, is provided by a cut away portion of front cover, depicted by boundary line curve (wave curve) ST1. This cut away permits visual identification of the file folder top sheet contents when the file folder is closed as shown in FIG. 4*a*. The hinge STH2 permits panel STP3 to fold back into panel portion STP2 by either folding the panel portion out or in. Retaining panel RPST is provided for to provide selective containment along the bottom edge. The leading edge of the panel is placed substantially at the distance DSTH2. The slanted part of the panel permits parallel expansion of STH1 and STH3 as the file is filled as in FIG. 4*b* when panel STP3 is locked between panel STP1 and RPST to permit an essentially open configuration with selective containment along the spine and the bottom edge without the use of any other means of closure. The pocket can be a substantially rigid clear or opaque poly plastic like a polypropelene or a polyethelene. It can be paper board of various weights from tag stock to press board, or it can be a film laminated paperboard or similar or like construction. What is provided for, as shown in FIGS. 1, 2, 3, 4, 4*a*, and 5, 5*a* where the numbered items refer to structure material to this claim, is an essentially open file folder having a hinged front cover, where the hinge is substantially midway between the outer most front cover edge and the outermost spine hinge, and having an expansion hinge spine STH1-H1' and having a retaining panel along a portion of the bottom edge of the back panel such that the leading edge of the retaining panel is substantially the distance of the front panel hinge from the spine, and further where the retaining panel has an expansion spine and a tongue portion for locking the foldable portion of the front cover, the expansion hinge portion for permitting expansion of the file folder and in particular for permitting expansion when the front panel portion is locked in folded back position between the retaining panel and the back panel. Further, what is provided for is an essentially open file folder having a hinged front cover, where the hinge is substantially midway between the outer most front cover edge and the outermost spine hinge, and having an expansion hinge spine STH1-H1' and having a retaining panel along a portion of the bottom edge of the back panel such that the leading edge of the retaining panel is substantially the distance of the front panel hinge from the spine, and further where the retaining panel has an expansion spine and a gradient slant away from the leading edge and further has a tongue portion for locking the foldable portion of the front cover, the gradient and expansion hinge portions for permitting expansion of the file folder and in particular for permitting expansion when the front panel portion is locked in folded back position between the retaining panel and the back panel. In particular, what is provided for is an essentially open file folder having at least a back panel(P1'") and a front panel(FP2"" comprising(P2"", and P2.v)), said back panel comprising a set of back panel sides, side 1, side 2, side 3, and side 4, at least two of said each of said sides being substantially orthogonal one to the other, said front panel comprising a set of front panel sides, side 1, side 2, side 3 and side 4, at least two of said each of said front panel sides being substantially orthogonal one to the other, and, wherein said front panel and said back panel are hingedly attached along a common side forming a spine hinge(H), said spine hinge being orthogonal and coterminous with both of said each of said other two sides, said front panel having a first(P2.v) and second(P2"") portion hingedly attached along a front panel first portion second portion hinge(H4), said each of said hinges(H,H4) being substantially parallel one to the other, said front panel first portion second portion hinge(H4) being set a predetermined distance (DSTH2) from said spine hinge forming a front panel first portion of predetermined length(FL1') and a front panel second portion of predetermined length(FL1") such that said front panel second portion can fold back inward or outward along said front panel first portion second portion hinge(H4) into a position substantially onto and coplanar with said front panel first portion, said back panel(P1'") further comprising a retaining panel(RPS') along one of said back panel sides orthogonal to said back panel side which forms said spine hinge, said retaining panel comprising at least a set of retaining panel sides, retaining panel side 1(RPS1'), retaining panel side 2(RPS2'), retaining panel side 3(RPS3'), and retaining panel side 4, said each of said retaining panel sides being connected one to the other, with at least one of said retaining panel sides having a point which is coterminous with said retaining panel leading edge location(RPLE1), forming a folding tab portion(RPS') protruding off said back panel side, where in one of said retaining panel sides is colinear with said back panel side to which it is attached, forming a retaining panel hinge(STH3), said retaining panel further having at least a retaining panel length(RPL4), and a retaining panel leading edge location(RPLE1), said retaining panel leading edge being a predetermined distance (DSTH2) from said spine hinge, where in said predetermined distance(DSTH2) of said retaining panel leading edge from said spine hinge is no greater than said predetermined distance of said front panel first portion second portion hinge from said spine hinge(DSTH.2), such that when said retaining panel is folded into said file folder about said retaining panel hinge, and said front panel second portion is folded into said file folder about said front panel first portion second portion hinge into a substantially coplanar position with said front panel first portion, and said front panel first portion is folded about said spine hinge into a position substantially coplanar with said back panel, and said front panel second portion is tucked between said retaining panel and said back panel, said essentially open file folder is placed into a locked closed position, with said front panel second panel portion hidden from view, for retaining papers in such fashion as to allow a portion of the papers to be expose for viewing, while at the same time providing containment along said back panel side housing said retaining panel.

Figure 5:
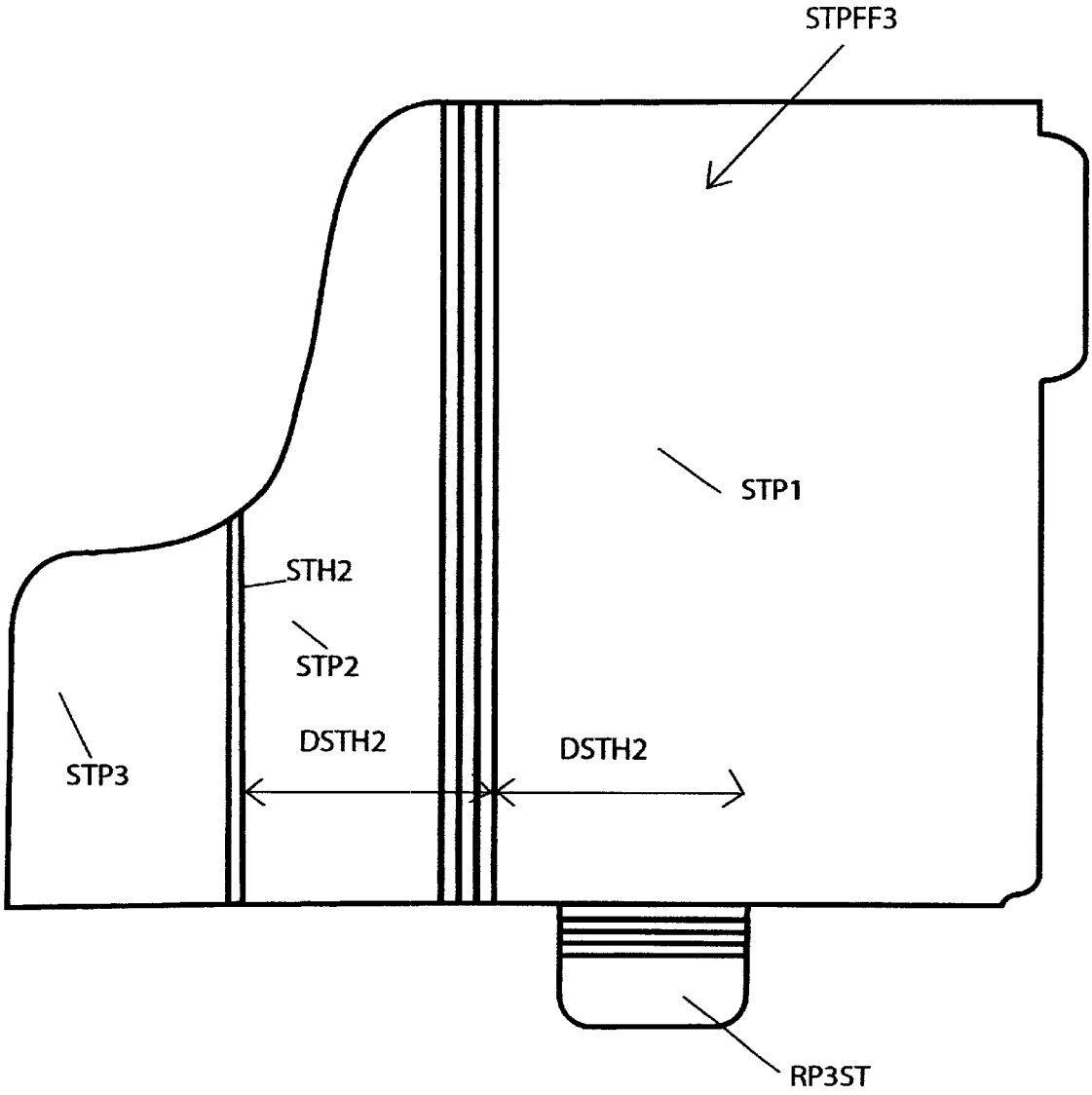
FIG. 5 shows the file folder of FIG. 4 with a straight retaining panel construction.
Figure 5A:
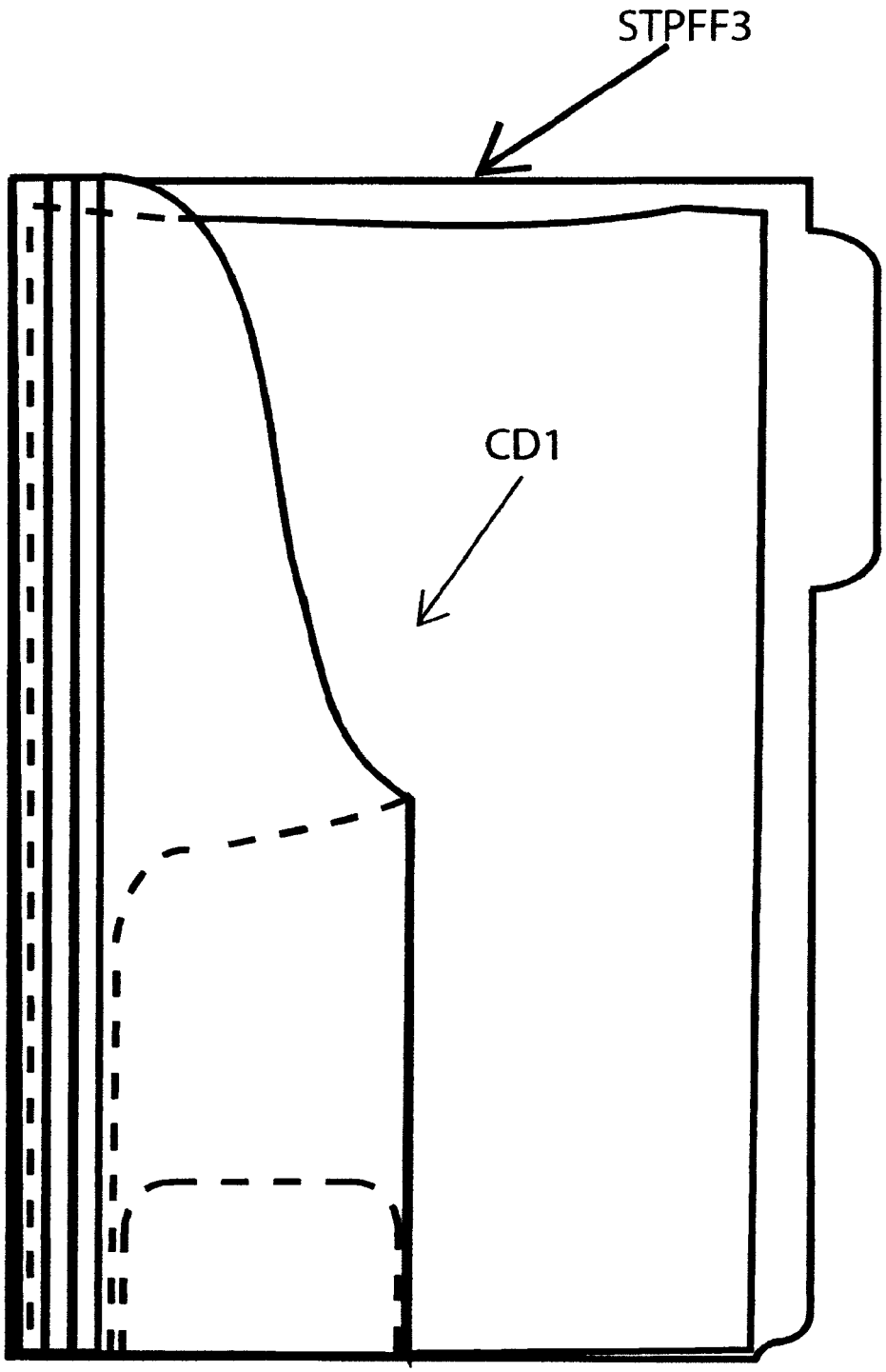
FIG. 5*a* shows the file folder of FIG. 5 locked open with a leaf of paper contained therein.

FIG. 5 shows a shortened retaining panel whose leading edge is substantially DSTH2 distance from the spine, coinciding with distance DSTH2 of front panel H2. This configuration provides locking of the front cover behind the flap STP3 but does not offer predetermined expansion. The self typing feature is provided by the cut out portion of the front panel and by the fold back portion of the front panel. As shown in FIG. 5*a* where more than ½ of the surface of contained document CD1, is exposed.

The ability to provide a self typing file folder that permits identification of the contents when closed, and also permits at least 2 edges of containment and further provides for a box like partially open state, for example as shown in FIG. 9*b*, for filing and access has not been previously available.

List of reference numerals

| Part # | Description |
|---|---|
| P1 | Back panel opaque |
| P2 | front panel first portion opaque |
| P2' | front panel second portion opaque |
| BS1 | back panel side 1 |
| BS2 | back panel side 2 |

-continued

List of reference numerals

| Part # | Description |
|---|---|
| BS3 | back panel side 3 |
| BS4 | back panel side 4 |
| T1 | tab ⅓ cut 1 |
| T2 | tab ⅓ cut 2 |
| T3 | tab ⅓ cut 3 |
| H | spine hinge for preferred embodiment |
| H1 | hinge for expansion 1 |
| H1' | hinge for expansion 2 |
| H1" | hinge for expansion 3 |
| H1'" | hinge for expansion 4 |
| EX1 | expansion portion 1 |
| Ex2 | expansion portion 2 |
| EX3 | expansion portion 3 |
| H2 | front panel first portion second portion hinge |
| FS1 | front panel side 1 |
| FS2 | front panel side 2 |
| FS3 | front panel side 3 |
| FS1' | front panel first portion side 1 |
| FS3' | front panel first portion opposing side 2 |
| FS1" | front panel second portion side 1 |
| FS3" | front panel second portion opposing side 2 |
| FL | front panel length |
| FL1" | front panel second portion length |
| FL1' | front panel first portion length |
| WD | file width predetermined |
| HT | file height predetermined |
| 4 | optional insertion tab |
| 4"" | optional hinge for insertion |
| 4' | hinge insertion slot optional |
| 4" | easy hole for insertion slot |
| 4"' | opposing easy hole for insertion slot |
| RP5 | retaining panel five |
| RPS1 | retaining panel side 1 |
| RPS2 | retaining panel side 2 |
| RPS3 | retaining panel side 3 |
| RPL4 | retaining panel length |
| RPS4 | retaining panel side 4 |
| H3 | hinge 3 for attaching retaining panel |
| H3' | expansion hinge 1 for retaining panel |
| H3" | expansion hinge 2 for retaining panel |
| H3"' | expansion hinge 3 for retaining panel |
| AH | hole 1 for elastic string insertion |
| B'H | hole 2 |
| B"H | hole 3 |
| C'H | hole 4 |
| C"H | hole 5 |
| DH | hole 6 |
| AHG | Ah hole metal (or plastic) grommet reinforcer |
| H5 | preferred embodiment retaining panel expansion hinge |
| IC1 | inner corner 1 |
| OC1 | outer corner 1 |
| IC2 | inner corner 2 |
| OC2 | outer corner 2 |
| ST1 | elastic string comprising CL1/DST1/C"ST1/C'St1/B"ST1/B'ST1/AST1/C2 |
| CL1 | elastic string clamp |
| CL2 | opposing elastic string clamp |
| EX4 | panel on expansion hinge for receiving adhesive |
| AD1 | adhesive for attaching see through panel to EX4 |
| FP2" | front cover of preferred embodiment comprising 2 panel portions |
| P1' | (opaque) base panel whole pattern and opaque nonhinged front panel(can be see through) |
| P2" | (opaque) non hinged front panel portion can be see through(as any opaque portion can be) |
| P1" | (opaque) base panel for attaching to a full non hinged clear front panel |
| P2'" | see through non hinged full front panel |
| H4 | hinge for rotating see through front panel portion |
| P"' | opaque base panel for attaching a partial see through front panel portion |
| P2/v | opaque portion front panel for receiving a see through portion front panel |

-continued

List of reference numerals

| Part # | Description |
|---|---|
| AT1 | portion of front panel part P1/v for attaching see through portion |
| AD2 | Adhesive for attaching partial see through portion |
| STPFF1 | self typing project file folder #1 |
| STP1 | back panel (clear or opaque) |
| STP2 | front panel first portion (clear or opaque) |
| STP3 | front panel second portion (clear or opaque) |
| ST1 | self typing cutaway portion from first panel boundary line |
| STH1 | spine hinge |
| STH1' | spine hinge expansion hinge first hinge |
| STH1" | spine hinge expansion hinge second hinge |
| STH1"' | spine hinge expansion hinge third hinge |
| RPST | retaining panel for self typing file folder |
| STH3 | retaining panel hinge |
| STH3' | retaining panel expansion hinge first hinge |
| STH3" | retaining panel expansion hinge second hinge |
| STH3"' | retaining panel expansion hinge third hinge |
| RH3 | gradient hinge portion expansion hinge for allowing expansion when second panel part interlocked there with |
| RPST' | tongue portion of retaining panel for holding paper and for locking second panel part when interlocked therewith |
| STPFF2 | selftyping project file folder #2 |
| STP1' | back panel portion |
| STP2' | front panel portion |
| ST2' | slash boundary line cut away for second pocket panel front panel |
| STPFF3 | self typing project file folder (3) three |
| STP1 | back panel portion |
| STP2 | front panel first portion |
| STP3 | front panel second portion |
| RP3ST | retaining panel portion |
| STPFP4 | self-typing project file folder #4 |
| SF3 | fold over edge portion for preventing delamination and otherwise strengthening back panel portion |
| SF3" | fold over portion two |
| SF3"' | fold over portion three |
| SF3P | partial fold over portion (four) |
| STP1" | back panel portion (opaque) |
| STP2" | front panel first portion(clear or opaque with see through hole) |
| STP3" | front panel second portion(clear or opaque with see through hole) |
| STHO1 | hole 1 |
| STHO2 | hole 2 |
| RPST' | retaining panel with expansion gradient |
| STPFF4H | front panel hinge |
| ST2' | string elastic grometted version locked down at holes STTH1 and STTH2 |
| STTH1 | lock down hole 1 for elastic string |
| STTH2 | lock down hole 2 for elastic string |
| SF3'V | detention portion in fold over edge portion for permitting hinge STPFF4H to fold without resistance |
| STPFF4H | front panel hinge |
| STPFF5 | self typing file folder 5 |
| V1 | velcroe patch rough hook |
| V1' | velcroe patch mate to rough hook |
| STPFF6 | self typing project file folder 6 |
| M1 | magnet 1 |
| M1' | magnet(or metal) 2 |
| SF3'V' | cut out portion for fold over edge to permit spine hinge |
| STPFF1H | spine hinge of STPFF4 |
| STPFF7 | selftyping project file of folder seven with horizontally Laminated clear see through portion |
| STP1P | opaque bottom portion of file folder |
| STP2P | clear see through plastic top portion of file folder |
| STP2P' | top clear portion of back panel |
| STP1P' | bottom opaque portion of back panel |
| STP2P" | top clear portion of front panel |

-continued

List of reference numerals

| Part # | Description |
|---|---|
| STP1P" | bottom opaque portion of back panel |
| ADH | adhesive for attaching see through and opaque portions |
| ATH | panel part where see through and opaque portions attached with adhesive ADH |
| RPLE1 | retaining panel leading edge 1 |

CONCLUSION

The provision of an essentially open file folder that has the property that its cover can be locked into a partially open position by interlocking with a retaining panel on the rear cover allows for the ability to use a file folder in a useful and new way. Not only does the retaining panel prevent papers from falling through the bottom of the file folder when closed in traditional form, the provision of an offset panel portion prevents the panel portion from being seen when the front panel portion is itself "half folded back". This hides the feature of the locking means which yields a clean and crisp look while allowing the pages to be thumbed back to selectively view each and every sheet contained therein. The placement of the leading edge of the retaining panel "behind" the hinge of the front panel provides for the additional unexpected benefit of being able to lock the hinged portion of the front panel into the retaining panel, thus providing an substantially open box like structure for more securely retaining papers. This file folder retains the primary advantages of a traditional file folder which is to be easily opened with both covers lying on opposing sides of the spine in the same plane so as to permit full access to all pages contained therein, while selectively offering closure along the bottom edge with two levels of containment, the first being loose such that the papers can be quickly accessed in full open form, and the second being boxed in, with pages being held interior to the locking elements as detailed above. This feature allows for more aggressive handling of the file folder at the desk top, in transport, or in a step file application without the papers falling out unexpectedly. This feature also allows the file folder to be deployed vertically as opposed to solely horizontally. This can be useful in a step file where orientation of the papers is retained with the normal vertical orientation they would be handled with once accessed. In contract with plastic project file folders which have large commercial appeal in Europe and more recently in North America, the invention here offers new life to traditional file folders in the desk top and shuffle filing area of project type or "context driven filing". The popularity of plastic file folders, which are normally sealed on two adjoining orthogonal edges are such that they are displacing traditional file folders in desk top or context filing applications. The combination of features provided for in this invention move the traditional file folder into competition with plastic "project file folders" providing a similar form of containment along two orthogonal corners, while retaining the traditional appeal of a fully open file folder. This is done at only minimal cost increase over the traditional file folder.

What is claimed is:

1. An essentially open file folder said essentially open file folder having the ability to be placed into a locked closed position, said essentially open file folder formed from a pliable material with semi-rigid properties and having the ability to hold its shape while at the same time to be folded into multiple panels, the folder having at least a back panel and a front panel, said back panel comprising a set of back panel sides, side 1, side 2, side 3, and side 4, at least two of said sides being substantially orthogonal one to the other,one of said orthogonal sides comprising a back panel vertical side and one of said orthogonal sides comprising a back panel horizontal side, said front panel comprising a set of front panel sides, side 1, side 2, side 3 and side 4, at least two of said front panel sides being substantially orthogonal one to the other,one of said orthogonal front panel sides comprising a front panel vertical side and one of said orthogonal front panel sides comprising a front panel horizontal side and, wherein said front panel and said back panel are hingedly attached along said vertical sides,thereby forming a spine hinge, said horizontal sides being substantially colinear one with the other, said front panel having a front panel first portion and a front panel second portion hingedly attached one to the other along a front panel first portion second portion hinge, each of said hinges being substantially parallel one to the other, said front panel first portion second portion hinge being set a predetermined distance from said spine hinge wherein said front panel first portion comprises a predetermined length and said front panel second portion comprises a predetermined length, such that said front panel second portion can fold back inward or outward along said front panel first portion second portion hinge into a position substantially onto and coplanar with said front panel first portion, said back panel further comprising a retaining panel, said retaining panel comprising at least a set of retaining panel sides, retaining panel side 1, retaining panel side 2, retaining panel side 3, and retaining panel side 4, wherein one of said retaining panel sides is a retaining panel side opposing said spine hinge, and one of said retaining panel sides is colinear with said horizontal back panel side forming a retaining panel hinge, thereby forming said retaining panel as a folding tab portion protruding off said horizontal back panel side, said retaining panel further having at least a retaining panel length, and a retaining panel leading edge location, said retaining panel leading edge location being a predetermined distance from said spine hinge, and further wherein said retaining panel side opposing said spine hinge has a point which is coterminous with said retaining panel leading edge location,wherein said predetermined distance of said retaining panel leading edge location from said spine hinge is no greater than said predetermined distance of said front panel first portion second portion hinge from said spine hinge, such that when said retaining panel is folded into said file folder about said retaining panel hinge, and said front panel second portion is folded into said file folder about said front panel first portion second portion hinge into a substantially coplanar position with said front panel first portion, and said front panel first portion is folded about said spine hinge into a position substantially coplanar with said back panel, and said front panel second portion is tucked between said retaining panel and said back panel, said essentially open file folder is placed into a locked closed position, with said front panel second portion hidden from view, for retaining papers with said front panel second portion folded in and locked under said retaining panel as to allow a portion of the papers to be exposed for viewing, while at the same time providing containment along said back panel side to which said retaining panel is attached.

2. The essentially open file folder of claim 1 wherein said front panel has at least one expansion hinge formed therein, where said at least one expansion hinge is substantially parallel to said spine hinge, and wherein said retaining panel side opposing said spine hinge comprises a gradient portion with a point of origin at said retaining panel leading edge location, said gradient portion of said retaining panel side formed in said side opposing said spine hinge, for allowing expansion of said file folder when said file folder front panel second portion is folded in and locked under said retaining panel and said front panel expansion hinge is expanded.

3. The essentially open file folder of claim 1 wherein said retaining panel further comprises at least one retaining panel expansion hinge which hinge is substantially parallel to said retaining panel hinge.

4. The essentially open file folder of claim 1 wherein said pliable material is paperboard.

5. The essentially open file folder of claim 1 wherein said pliable material is a poly plastic material.

* * * * *